US005099630A

United States Patent [19]

Bolmgren

[11] Patent Number: 5,099,630

[45] Date of Patent: Mar. 31, 1992

[54] BUILDING COMPONENTS, ESPECIALLY FOR WALL CONSTRUCTION, AND BRICKS WHICH ARE SEMI-FINISHED MEANS FOR MANUFACTURING THE SAME

[75] Inventor: Ake G. Bolmgren, Gran Canaria, Spain

[73] Assignee: Mats Johan Jungholm, Spain

[21] Appl. No.: 196,821

[22] Filed: May 19, 1988

Related U.S. Application Data

[63] Continuation of Ser. No. 289,834, Aug. 3, 1981, abandoned, which is a continuation of Ser. No. 81,063, Oct. 2, 1979, abandoned.

[30] Foreign Application Priority Data

Oct. 3, 1978 [SE] Sweden ..... 7810345-4

[51] Int. Cl.[5] ..... E04B 2/00

[52] U.S. Cl. ..... 52/442; 52/100; 52/218; 52/405; 52/426

[58] Field of Search ..... 52/98, 100, 218, 244, 52/249, 389, 404, 405, 410, 425, 569, 125, 442, 426

[56] References Cited

U.S. PATENT DOCUMENTS

| | | | |
|---|---|---|---|
| 1,134,741 | 4/1915 | Hill | 52/98 |
| 1,210,287 | 12/1916 | Epner | 52/98 |
| 1,355,580 | 10/1920 | Tyson | 52/569 |
| 1,403,953 | 1/1922 | Heath | 52/98 |
| 1,422,814 | 7/1922 | Bartelt | 52/569 |
| 1,581,574 | 4/1926 | Heath et al. | 52/100 |
| 1,653,771 | 12/1927 | Keichline | 52/100 |
| 2,018,541 | 10/1935 | Austin | 52/100 |
| 2,151,798 | 3/1939 | Raad | 52/100 |
| 2,881,613 | 4/1959 | Taylor et al. | 52/442 |
| 3,204,376 | 9/1965 | Elgenstiena | 52/125 |
| 3,581,777 | 6/1971 | Hodges | 52/218 |
| 3,873,402 | 3/1975 | Mrasek | 52/100 |

FOREIGN PATENT DOCUMENTS

| | | | |
|---|---|---|---|
| 36093 | 6/1926 | Denmark | 52/218 |
| 50163 | 4/1935 | Denmark . | |
| 622414 | 11/1935 | Fed. Rep. of Germany . | |
| 808379 | 7/1951 | Fed. Rep. of Germany . | |
| 3974 | 11/1955 | Fed. Rep. of Germany | 52/98 |
| 2026392 | 9/1970 | France | 52/218 |
| 412391 | 12/1945 | Italy | 52/425 |
| 36509 | 1/1923 | Norway . | |
| 34808 | 1/1910 | Sweden . | |
| 171603 | 6/1960 | Sweden . | |
| 190669 | 6/1964 | Sweden . | |
| 201759 | 2/1966 | Sweden | 52/389 |
| 83083 | 11/1919 | Switzerland | 52/98 |
| 558858 | 2/1975 | Switzerland | 52/98 |
| 24235 | 10/1910 | United Kingdom | 52/442 |

*Primary Examiner*—David M. Purol
*Attorney, Agent, or Firm*—Finnegan, Henderson, Farabow, Garrett & Dunner

[57] ABSTRACT

Brick building components made by splitting a whole brick having suitable slots, the split bricks being provided with slots into which reinforcement means can be fitted. A greatly increased tensile strength, both vertically and horizontally, is obtained, providing sufficient strength for manufacturing transportable, prefabricated components.

2 Claims, 3 Drawing Sheets

BUILDING COMPONENTS, ESPECIALLY FOR WALL CONSTRUCTION, AND BRICKS WHICH ARE SEMI-FINISHED MEANS FOR MANUFACTURING THE SAME

This application is a continuation of application Ser. No. 06/289,834, filed Aug. 3, 1981, now abandoned which is a continuation of Ser. No. 81,063, filed Oct. 2, 1979 now abandoned.

The invention relates to the manufacture of brick walls and the like, especially in the form of prefabricated components or panels, with or without insulation, and in which the layer or layers of brick can be of small thickness.

Brick is a material which is especially durable and has a number of advantages, such as high resistance to moisture and freezing, density, color fastness to light, good appearance, especially with age, etc. Although a brick wall has unequaled advantages, the high costs of building on site and the appearance of modern competitive insulating materials such as fiberglass and mineral-wool mats have resulted in a sharp decrease in the use of masonry brick walls.

The purpose of the invention was to achieve a brick wall which would meet the requirements of prefabrication or the like and good insulation, combined with the known advantages of brick walls.

An initial problem which arises is that one must be able to make thinner bricks. More specifically, it is very difficult to manufacture bricks in the form of thin plates, since under normal drying and firing conditions they tend to warp. So, even if it is possible in principle to manufacture such bricks, the percentage of discards for defects is unacceptably high.

In making prefabricated or movable panels of masonry brick, a second problem presents itself, namely the tensile strength of both the bricks and the masonry joints is insufficient. A prefabricated panel or other component must be capable of being transported long distances, be lifted into place and anchored etc., and therefore it requires greater strength than that required in a wall which is built up in place. Not even in walls which are built in place with thin bricks can this problem be considered as solved in a way which fulfills those strength requirements which are desirable.

Therefore, it is desirable in walls comprising thin bricks to be able to increase the tensile strength by laying in reinforcement.

According to the invention, both of these problems are solved at the same time by making thin bricks by splitting, the split bricks having slots in which reinforcement rods, stretched wires or the like can be fitted. The effect of this is especially advantageous if the slots intended for the reinforcement rods are sufficiently deep so that the rods will be at or near the middle of the bricks and thus near the neutral axis of the panel made of brick and mortar. A greatly increased tensile strength in one direction is the result. If one wishes to achieve a corresponding effect in a direction perpendicular thereto, reinforcement can also be laid into the horizontal joints which are perpendicular to the reinforcement rods, either by laying down a metal net or the like or by using fiber-mixed mortar.

Splitting of bricks has been known for a long time. To facilitate splitting, fractural indications of different types have been made as the bricks are manufactured, such as grooves on the outside of the brick or channels on the inside. Examples of this are given in Swedish Patent Specification 34 808, German Patent Specification 808 379, Swedish Patent Specification 171 603, Danish Patent Specification 50 163 and German Patent Specification 622 414. In many of these cases the fractural indications are combined with, or alternatively can function as, holes for reducing weight and increasing insulating capacity.

It is also known to arrange brick walls with reinforcing rods, as described in Norwegian Patent Specification 36 509. As disclosed in this patent specification, reinforcing rods are placed in projections in each brick. These T-shaped bricks thus have a shape which makes them difficult to fire, as well as stack, transport and handle. The shape shown and described should not lead the person skilled in the art to the idea that the bricks for reinforced masonry walls should be made by splitting, after firing, of bricks which are better suited to firing.

An especially advantageous application of the invention presents itself if the prefabrication of sections is organized in such a way that reinforcement wires are arranged with suitable spacing so as to resemble the warp in a woven fabric. In place of the warp we have the rows of bricks made according to the principles of the invention and possibly reinforcements laid in the horizontal joints, which can be of wire, net or even fibers in the mortar. This provides satisfactory tensile strength in two orthogonal directions.

The bricks used for implementing the invention are first made in the form of whole bricks with essentially parallel-epipedic exterior shape. In the same manner as clay is injected moulded to produce so-called hollow brick, at least one slot opening is arranged along the longitudinal axis of the parallelepiped, with at least two cross slots branching off therefrom, which extend from said first-mentioned slot outwards in either direction, essentially half-way to each side surface. The brick is then quite easily split, into two halves for example, and the cross slots can hold the reinforcement which is already in place.

As is evident from the embodiments described below, it is possible to split the present brick and obtain other shapes, allowing one half to remain together with a portion of the other half. The complete system, which is suitably based on the new module dimension of 10 cm and multiples thereof, can preferably also include one or more auxiliary shapes in addition to a normal brick, from which the major proportion of bricks are made by splitting. Certain of the brick types obtained by splitting are also suitable for making corners.

Although the splitting of the bricks can be done as usual by hand, it is more efficient to do it by machine, using a device operating on the same well-known principle as a log splitter.

Although the invention was made primarily to solve the problem of making flat wall panels for building construction, it is easy to see that it can be used in many different ways. For example, the intended wall can be used in a chimney construction. The invention can be of great practical value in other masonry applications, such as brick furnace lining for metallurgical uses etc. where the low tensile strength of ordinary brick lining is a disadvantage. It will be understood that the reinforcement must be made of a material which can withstand the intended temperature and still have an appropriate coefficient of expansion, or that the reinforcement must be placed so that it is securely protected from heat.

The invention will now be described in more detail with reference to a pair of example which are shown in the figures.

FIGS. 3 A–G shows examples of bricks obtained by splitting.

Figure 4:
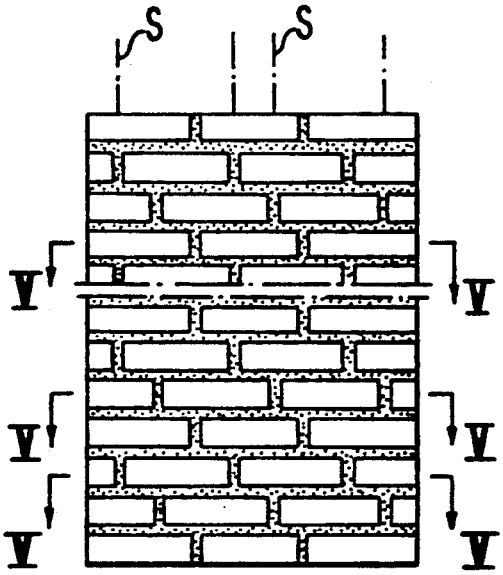

FIG. 4 shows an example of a facade section as seen from the front.

Figure 5:
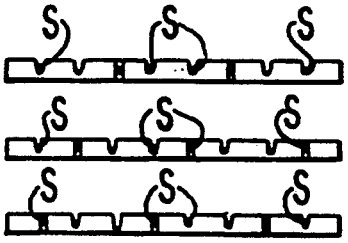

FIG. 5 shows three courses in the section in FIG. 4, each course corresponding to a portion of a layer of bricks.

Figure 6:
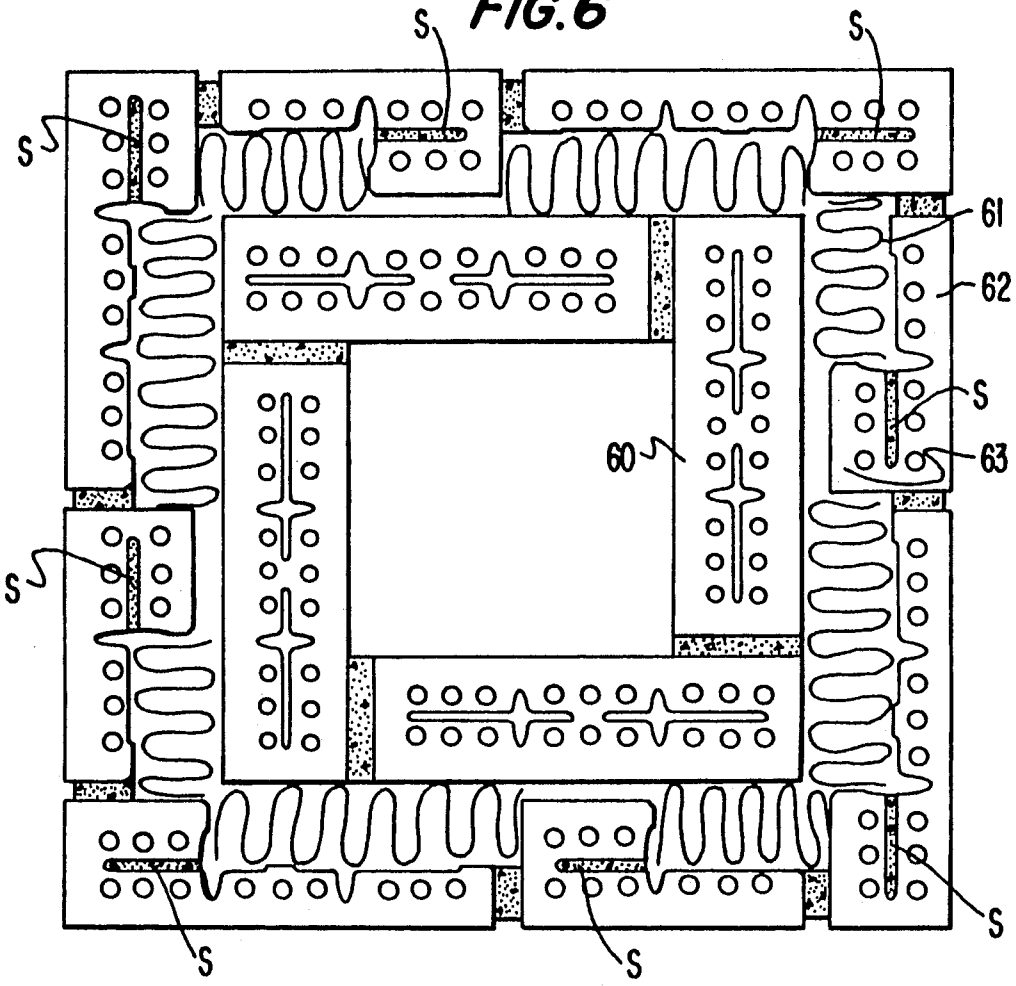

FIG. 6 shows a brick course in a square chimney built according to the principles of the invention.

Figure 1:
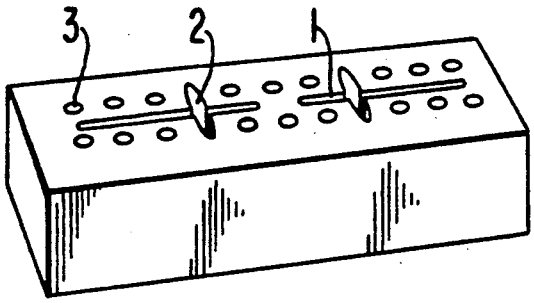
FIG. 1 shows a perspective view of a whole brick, in principle corresponding to a three-module normal brick in the system.

The brick shown in FIG. 1 is provided with two longitudinal slots 1, from which cross or branch slots 2 extend half-way to the long sides. In addition to these cross-shaped configurations there are holes 3 of conventional type in the brick arranged along the length of the brick. These holes 3 have no connection with the invention. They are designed to improve the insulating properties of the brick, reduce weight and also facilitate drying and firing of the brick during manufacture. This brick has a length of three modules with the assumed module length of 10 cm.

Figure 2:
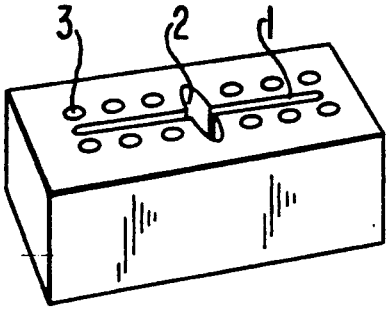
FIG. 2 shows a perspective view of a brick in an auxiliary shape with a two-module length.

The brick shown in FIG. 2 is similar to that in FIG. 1 but has a shorter length. This brick has an auxiliary shape from which bricks with essentially $\frac{2}{3}$ of the ordinary length can be split. (It is known that a three-module brick must be one joint width shorter than three module lengths and a two-module brick one joint width shorter than two modules.) It should be noted that a three modular length brick includes the width of a vertical masonry joint plus three module units. It should further be noted that a vertical masonry joint is the width of the mortar between opposite end faces of adjoining bricks in the same layer.

Bricks are now manufactured, as the person skilled in the art knows, almost exclusively by extruding clay through a suitably shaped die, and cutting off the clay column into bricks, which are then dried and fired. To obtain bricks like those shown in FIGS. 1 and 2 the die opening is provided with portions corresponding to the cross-shaped configurations.

It should be noted that it is also possible to use bricks without the holes 3 or with corresponding holes of another shape and/or configuration. The essential features are, firstly, that there are slots corresponding to the slots 1, to facilitate splitting, and secondly, slots 2 which are suited for holding reinforcement. It is intended that conceivable modifications, which are large in number, shall be encompassed by the invention. For example, it is conceivable to have grooves or slots to facilitate splitting on the outside of the brick as well (not shown).

Figure 3C:
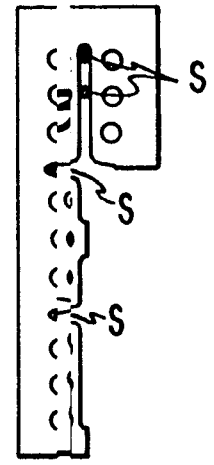
Figure 3B:
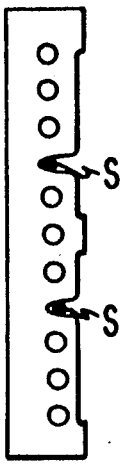
Figure 3A:
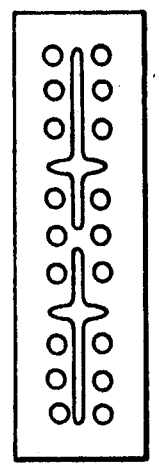
Figure 3E:
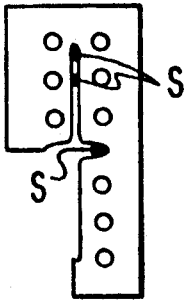
Figure 3D:
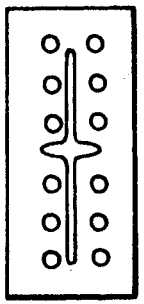
Figure 3G:
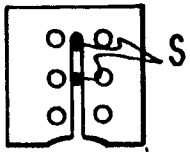
Figure 3F:
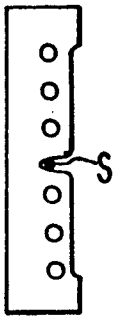

FIGS. 3A–G show several different forms of bricks, which can be split form the bricks shown in FIGS. 1 and 2, with whole top views being shown in FIGS. 3A and 3D. The points labelled S are the points where reinforcement can be placed with advantage.

FIGS. 4 and 5 illustrate how a thin, reinforced component can be built with the aid of bricks as shown in FIG. 3A and a few smaller sized bricks. The reinforcement rods S can be fixed at the ends of the wall in a suitable manner, e.g. bending them over the bottom and top courses, if they are not to be used for anchoring or transporting the panel.

Another example of a use for the invention is a square chimney, of which one course is shown in FIG. 6. In such a chimney, starting from the inside, there is a refractory brick lining 60, which can be made of whole bricks according to the invention, an insulating layer 61 filled with insulating agent, and a surrounding casing in the form of a brick shell 62. By virtue of the fact that the outer shell is made according to the invention, it is reinforced so that it can absorb tensile forces which ordinary masonry shells cannot. In the present construction the bricks in the outer shell are provided with inwardly directed projections with essentially the same thickness as the insulation layer, but these projections are not mortared to the interior lining, so that said lining can move in relation to the outer shell, e.g. through expansion when the chimney is heated by flue gases. The projections on the bricks prevent the insulating layer 61 from being reduced in thickness by stresses or otherwise. With the construction according to the invention, where the brickwork is able to absorb tensile stresses, the cross section of the chimney can be reduced appreciably while retaining its strength against wind forces, for example. It should be noted that only the surrounding shell 62 contains reinforcement rods (S), which are insulated against heating from flue gases by the inner refractory brick lining 60 (completely free of reinforcement rods) and by the insulating layer 61.

The person skilled in the art will understand that the bricks in the inner lining can be made without the cross-shaped slots 2 (FIGS. 1 and 2) but that the longitudinal slots 1 according to the invention are advantageous with respect to insulation.

The placement of the reinforcement rods (S) shown in FIG. 6 is only one example, especially applicable to chimneys. There is nothing to prevent placing additional reinforcement rods in the cross-shaped slots in the shell 62, especially when making flat or cornered wall components with intermediate insulating material, as the invention intends.

The chimney example also shows how bricks split in various ways can be used to make a reinforced brick structure with corners. The person skilled in the art will be able to calculate how the subsequent courses should be laid for brickwork of different types, which, as seen from the outside, can look exactly like ordinary brickwork. Although in the chimney example the outer wall is not cemented to the inner wall, it is clear that the same construction with projections in spaces bridged by bricks, can be used to cement together two brick shells on either side of an insulating material, e.g. rockwool.

The variations of the possible applications of the invention are practically unlimited, and it is clearly within the capacity of the person skilled in the art, with the aid of the above description of a pair of illustrative examples, to solve various building problems and the like by combining split bricks via the slots using a reinforcement means suited to the conditions. The arrangement of the manufacture of building components between brickworks, prefabrication plants and building sites is also considered to be a question of suitablility determined by local and other conditions.

What I claim is:

1. A building component for wall constructions comprising:

a pair of panels, each of said pair of panels having an outer side which shows bricks put together with masonry joints, each of said pair of panels being constructed of whole bricks which have been split, the outer side of each of said panels having brick surfaces which are relatively smooth and uninterrupted, the inner side of each of said pair of panels being formed with slots which extend from the inner side toward the outer side and to the middle of the thickness of the split bricks, and wire or shaft means such as piano wire or reinforcing rods fitted into said slots and running through the entire building component;

an insulation space between said pair of panels, said insulation space being bridged by brick projections remaining after the bricks have been split for facilitating cementing together of said pair of panels; and insulation disposed in said insulation space.

2. A building component intended as a chimney comprising:

a masonry flue lining;

a panel surrounding said lining, said panel having an outer side which shows bricks put together with masonry joints, said panel being constructed of whole bricks which have been split, the outer side of said panel having brick surfaces which are relatively smooth and uninterrupted, the inner side of said panel being formed with slots which extend from the inner side toward the outer side and to the middle of the thickness of the split bricks, and wire and shaft means such as piano wire or reinforcing rods fitted into said slots and running through the entire building component;

an insulation space between said panel and said lining, the insulation space being bridged by brick projections remaining when the bricks are split;

an insulating material essentially filling said insulation space, said brick projections constructed to prevent reduction in the width of said insulation space as the building component absorbs lateral forces.

* * * * *